US005944588A

United States Patent [19]

Marmillion et al.

[11] Patent Number: 5,944,588

[45] Date of Patent: Aug. 31, 1999

[54] CHEMICAL MECHANICAL POLISHER

[75] Inventors: Patricia M. Marmillion, Colchester; Anthony M. Palagonia, Underhill, both of Vt.

[73] Assignee: International Business Machines Corporation, Armonk, N.Y.

[21] Appl. No.: 09/104,473

[22] Filed: Jun. 25, 1998

[51] Int. Cl.[6] ..... B24B 7/00

[52] U.S. Cl. ..... 451/242; 451/41; 451/246; 451/339; 451/443

[58] Field of Search ..... 451/41, 242, 246, 451/245, 254, 258, 339, 443, 444, 456, 59, 60

[56] References Cited

U.S. PATENT DOCUMENTS

| | | | |
|---|---|---|---|
| 2,933,437 | 4/1960 | Loosme . | |
| 3,439,371 | 4/1969 | Kraft . | |
| 3,979,239 | 9/1976 | Walsh . | |
| 4,113,543 | 9/1978 | Salles et al. . | |
| 4,193,226 | 3/1980 | Gill, Jr. et al. . | |
| 4,907,931 | 3/1990 | Mallory, et al. . | |
| 4,910,155 | 3/1990 | Cote et al. . | |
| 4,934,102 | 6/1990 | Leach et al. . | |
| 4,944,119 | 7/1990 | Gill, Jr. et al. . | |
| 5,032,203 | 7/1991 | Doy et al. . | |
| 5,036,630 | 8/1991 | Kaanta et al. . | |
| 5,081,051 | 1/1992 | Mattingly et al. . | |
| 5,095,661 | 3/1992 | Gill, Jr. et al. . | |
| 5,144,711 | 9/1992 | Gill, Jr. . | |
| 5,177,908 | 1/1993 | Tuttle . | |
| 5,403,228 | 4/1995 | Pasch . | |
| 5,423,558 | 6/1995 | Koeth et al. . | |
| 5,433,650 | 7/1995 | Winebarger | 451/41 |
| 5,456,627 | 10/1995 | Jackson et al. . | |
| 5,487,697 | 1/1996 | Jensen | 451/41 |
| 5,584,749 | 12/1996 | Mitsuhashi et al. | 451/285 |
| 5,663,637 | 9/1997 | Li et al. . | |
| 5,679,060 | 10/1997 | Leonard et al. | 451/43 |

FOREIGN PATENT DOCUMENTS

| | | |
|---|---|---|
| 87053 | 1/1922 | Australia . |

*Primary Examiner*—Eileen P. Morgan
*Attorney, Agent, or Firm*—Scully, Scott, Murphy & Presser; Howard J. Walter, Jr. Esq.

[57] ABSTRACT

A chemical, mechanical polisher having a plurality of cylindrical rollers rotating orthogonally to a rotating work piece that they wipe and cover that are conditioned to uniformly receive a cleaning agent for polishing the work piece.

10 Claims, 10 Drawing Sheets

FIG. 9
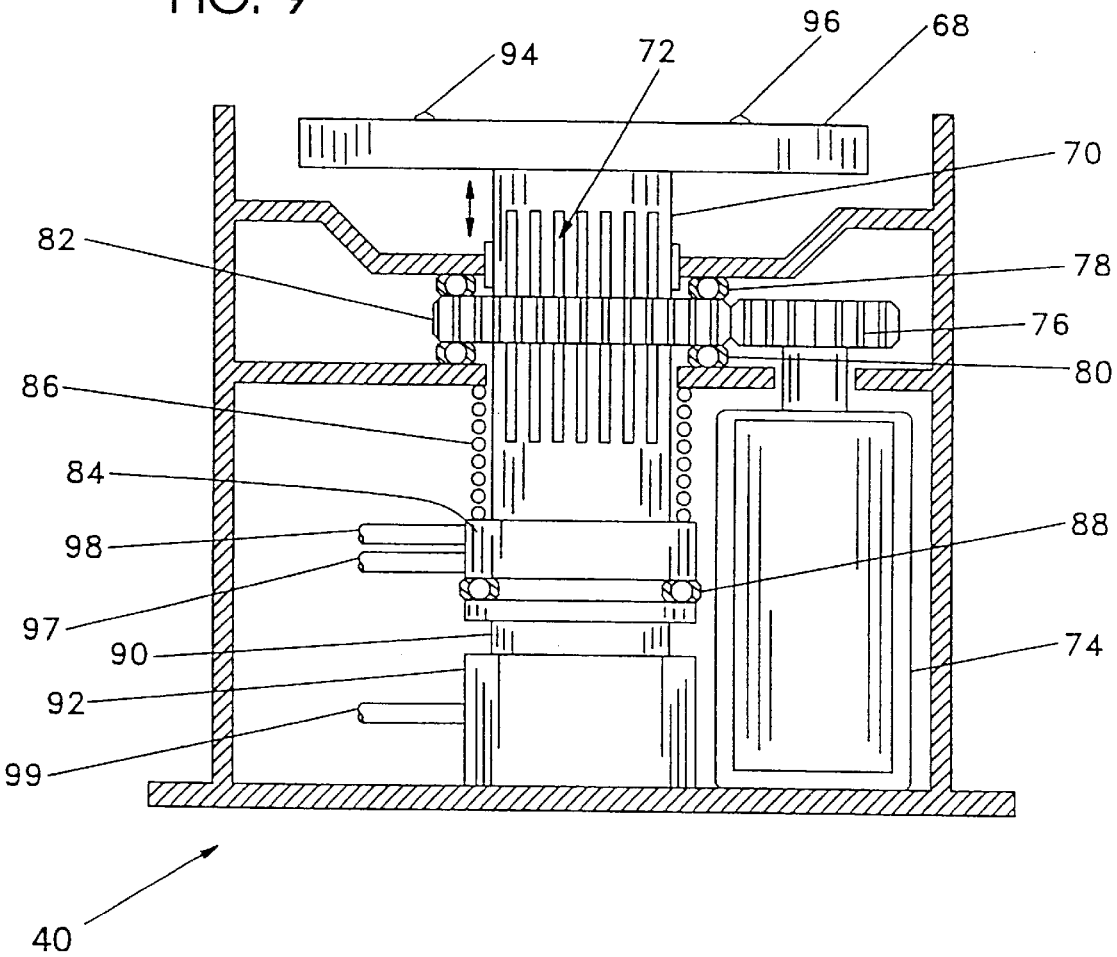
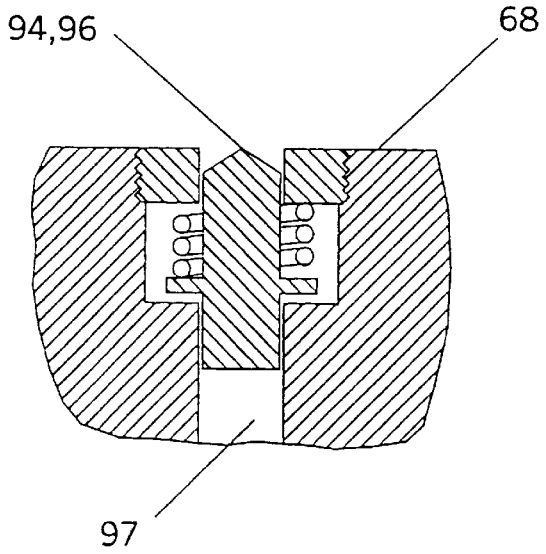
FIG. 9a

CHEMICAL MECHANICAL POLISHER

DESCRIPTION

FIELD OF THE INVENTION

This invention relates to a system which mechanically polishes wafers used in the manufacture of semiconductor elements.

As semiconductor elements become increasingly smaller, for example VLSI technology the wiring technology associated with such devices requires smaller wiring pitches. Additionally a multitude of interconnect levels are present. As each wiring level is added during device fabrication, those coincident steps cause the surface topography to become increasingly severe. Wafers which have initially rough surfaces create difficulties with each succeeding processing, step such as photolithography, RIE etching, insulation and metalization. Thus, a standing requirement in the manufacture of semiconductor devices is to begin with wafers which have a high degree of planarization.

BACKGROUND OF THE INVENTION

Prior art methods and apparatus for polishing a semiconductor wafer are shown by U.S. Pat. Nos. 3,439,371; 3,979,239; 4,193,226; 4,907,931; 4,910,155; 4,934,102; 4,944,119; 5,095,661; 5,144,711 and 5,403,228.

Improvements for prior art componentary used in the aforesaid are shown in U.S. Pat. Nos. 5,032,203; 5,036,630; 5,081,051; 5,177,908; 5,423,558 and 5,663,637.

With the exception of U.S. Pat. No. 4,934,102 assigned to the common assignee hereof and U.S. Pat. No. 3,439,371 the prior art apparatus and componentary deal with the use of flat pads in the polishing apparatus that are rotating under or over or a semiconductor wafer that may be itself rotating in a stationary plane or oscillating while rotating in a stationary plane to ensure full surface treatment.

As for U.S. Pat. Nos. 4,934,102 and 3,439,371 a roller, rather than a pad is employed and rotated perpendicularly to the plane of rotation for the wafer to polish one side of the semiconductor wafer.

It is in the improvement of this type of polishing apparatus that this invention is directed. More particularly, these current polishing apparatus have (1) leading edge and trailing edge slurry delivery problems resulting in non uniform fresh slurry contact over the entire wafer surface; (2) problems of wafer scratching due to slurry and etch residual agglomerations becoming embedded in the polish pad, traveling with the pad and scratching wafers; and (3) the problem of newer larger wafers increasing tool and pad size with doubtful uniform results.

SUMMARY OF THE INVENTION

Given the deficiencies of the prior art, it is an object of this invention to provide a device for polishing one side of a round, flat disc to a high degree of precision and uniformity.

A more particular object of this invention is to provide in a polishing tool a rotating work holder that will orient the flat disk to be polished in a horizontal position such that a set of multidirectional rotating coplanar cylindrical polishing rollers will contact one side of the first disk to enhance polishing uniformity.

Still another object of this invention is to provide enhanced polishing surface conditioning and cleaning with full length conditioners that will preclude embedding used slurry agglomerations into a porous surface being polished by the apparatus disclosed herein.

A still further object of this invention is to provide a total area polishing of a work piece without use of lateral wiping motion of a polishing apparatus.

Still another object of this invention is to provide with the aforesaid polishing apparatus a cleaning agent (slurry) delivery system that will have uniform, consistent delivery of polishing agent to the polishing area to thereby eliminate leading and trailing edge effects that occur with other prior art polishing apparatus.

It is a still further object of this invention to provide apparatus that will take several work pieces, such as semiconductor wafers and process such through a cleaning station a polishing station, a rinse station and thence to a storage cassette.

These and other objects of this invention are accomplished in a novel polishing apparatus that uses a plurality of cylindrical rollers for polishing a work piece, i.e. a semiconductor wafer, held by a work holder, i.e. platen, to rotate thereagainst on an axis orthogonal to the roller axis.

This invention will be described in greater detail by referring to the attached drawing and the description of the preferred embodiment which follows.

BRIEF DESCRIPTION OF THE DRAWINGS

FIG. 4;

FIG. 9 is a cross sectioned view of the wafer holding mechanism;

FIG. 9A is a partial cross section of the means in the wafer holder showing the lifter mechanism used to remove the wafer after polishing is complete;

DETAILED DESCRIPTION OF THE PREFERRED EMBODIMENTS OF THE INVENTION

Figure 1:
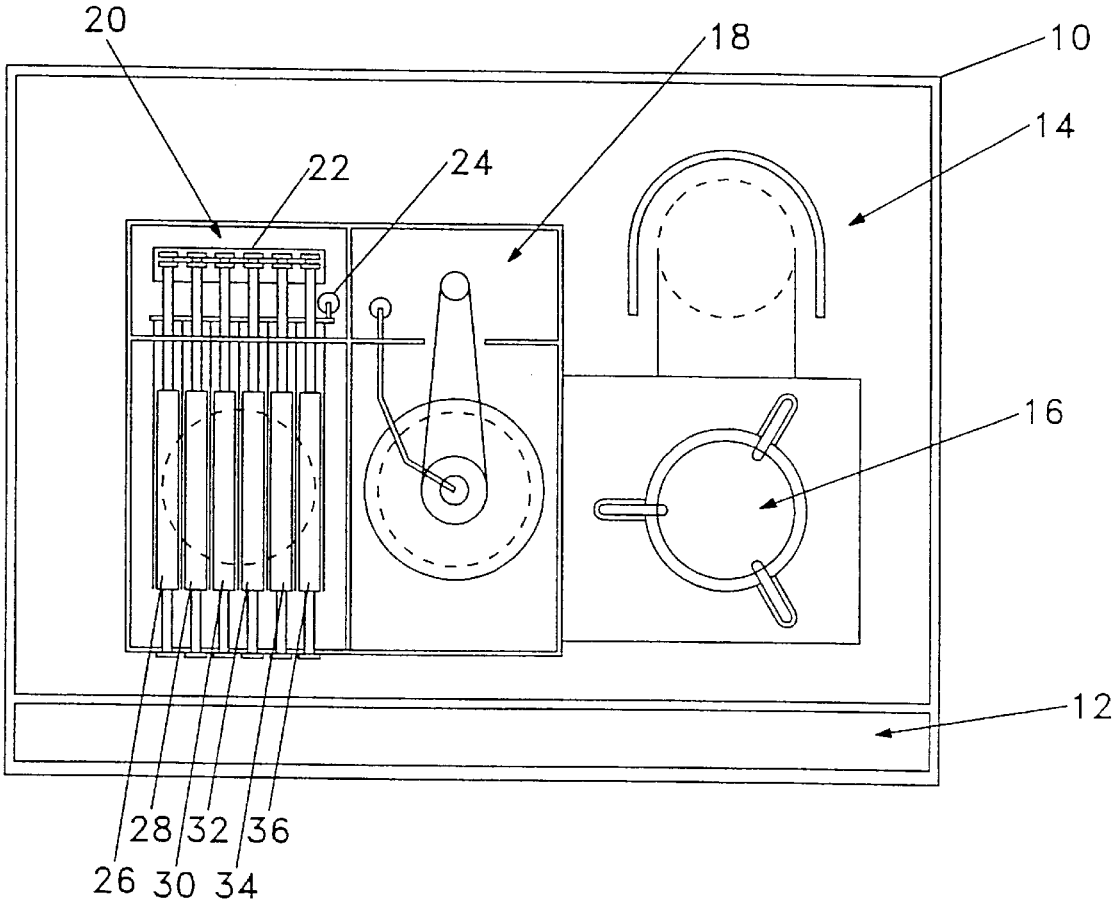
FIG. 1 is a top view of a polishing apparatus in accordance with this invention.

With reference to FIG. 1 there is shown a cabinet 10 housing controls in area 12, a wafer cassette 14, a wafer transfer station 16, a clean and rinse station 18 and a polishing station 20. In the polishing station there is located a pad and roller gear box 22, a cleaning agent (slurry) distribution system 24 and a plurality of cylindrical rollers 26 thru 36.

Figure 2:
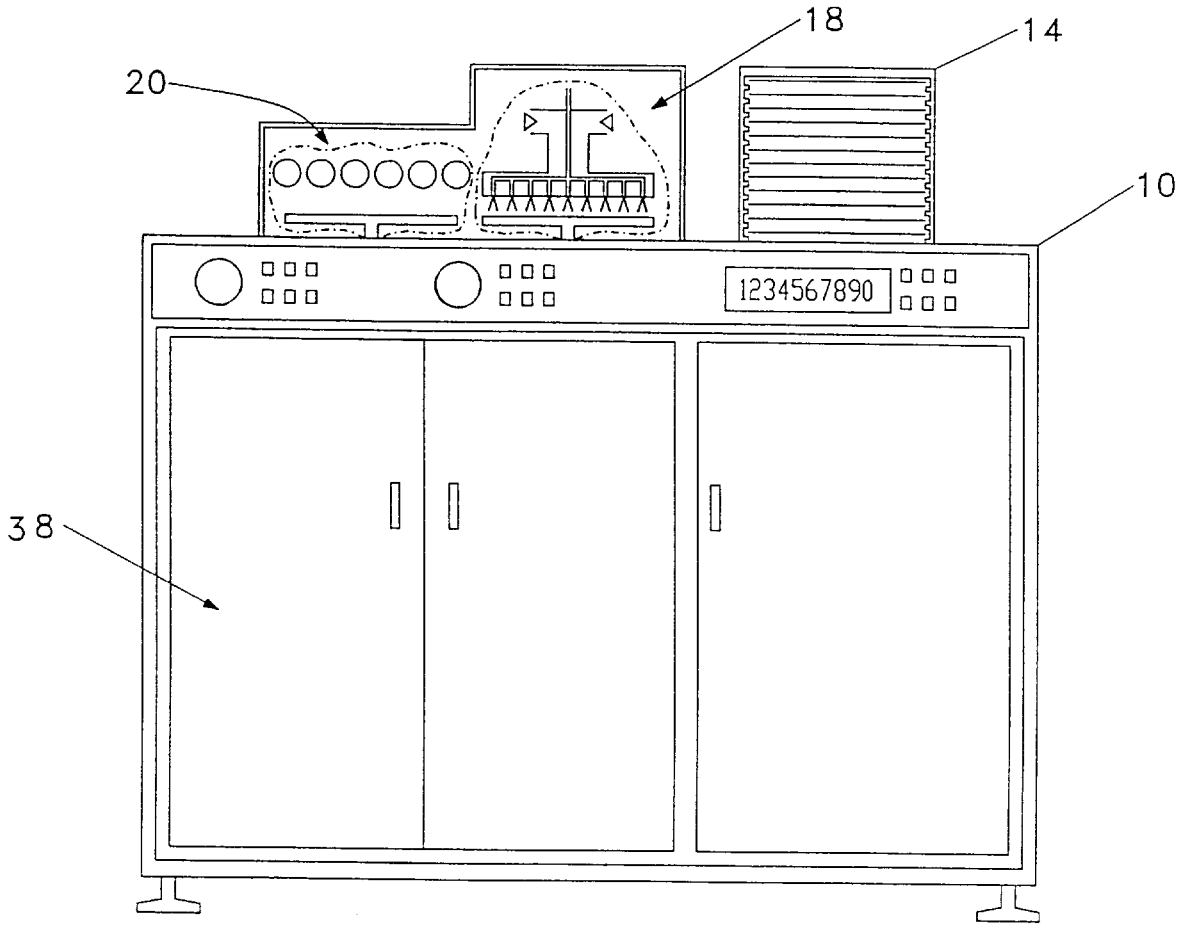
FIG. 2 is a side view of the polishing apparatus of FIG. 1.

As seen in FIG. 2 the wafer cassette 14 is a vertical feed device extending outside of cabinet 10 as are the cleaning/rinse station 18 and polishing station 20. Cabintry also contains a pump and slurry (cleaning agent) supply station.

Figure 3:
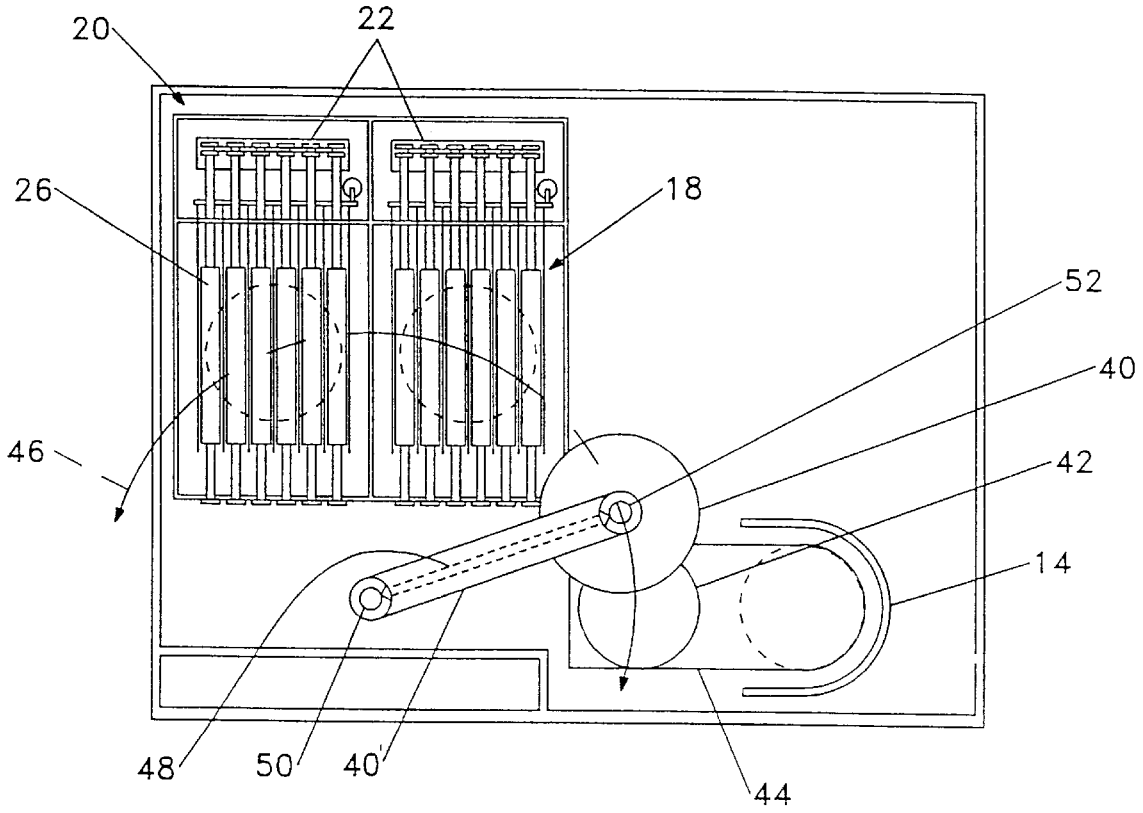
FIG. 3 is a top view of the polishing apparatus showing semiconductor wafer processing.
Figure 4:
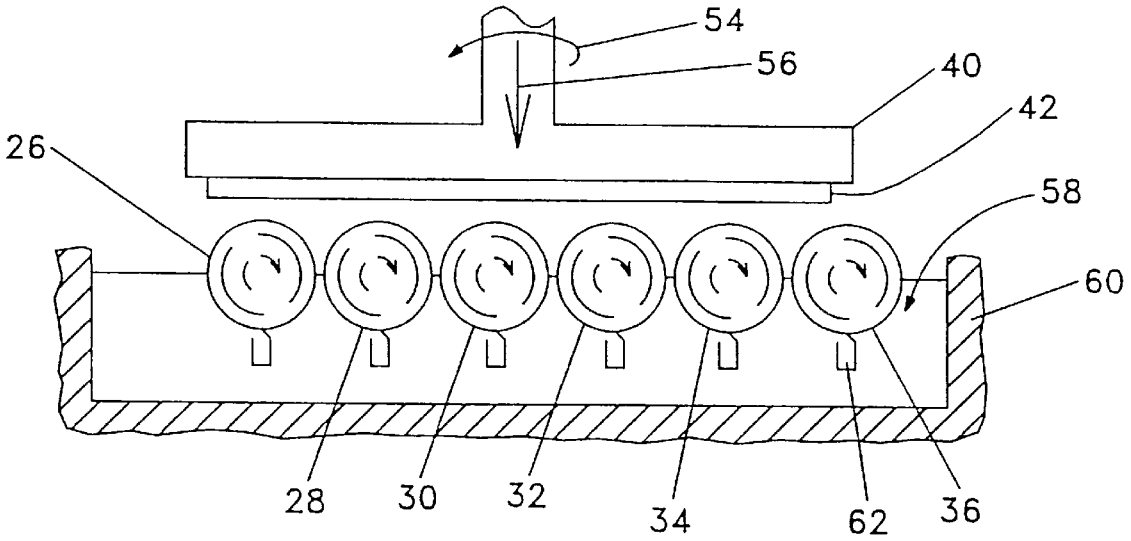
FIG. 4 is a partial view showing a relationship of polishing rollers with regard to a rotating work holder.

In FIG. 3 there is shown a rotating arm 40 that operates to pick up a work piece, in this case a semiconductor wafer 42 ejected from cassette 14 along tray 44 and move such through arc 46 into cleaning/rinse station 18 and polishing station 20 and back again to tray 44. A shaft 48 transfers rotation from drive 50 to the work holder 40's shaft 52 to, as seen by FIG. 4, rotate work holder, platen, 40 in direction of arrow 54 when lowering wafer 42, see arrow 56, so that the wafer 42 can be thoroughly polished by the rollers 26, 28, 30, 32, 34 and 36 rotating clockwise on their cylindrical axis, i.e. perpendicular to axis represented by arrow 56. In this embodiment a cleaning agent (slurry) 58 is held by tank 60 to surround the rollers 26 through 36 and a set of conditioners 62 are located in the tank to open the nap of the polishing surfaces of rollers 26 through 36 to facilitate absorption of the slurry 58 and removal of used slurry for reasons as aforesaid.

Figure 5:
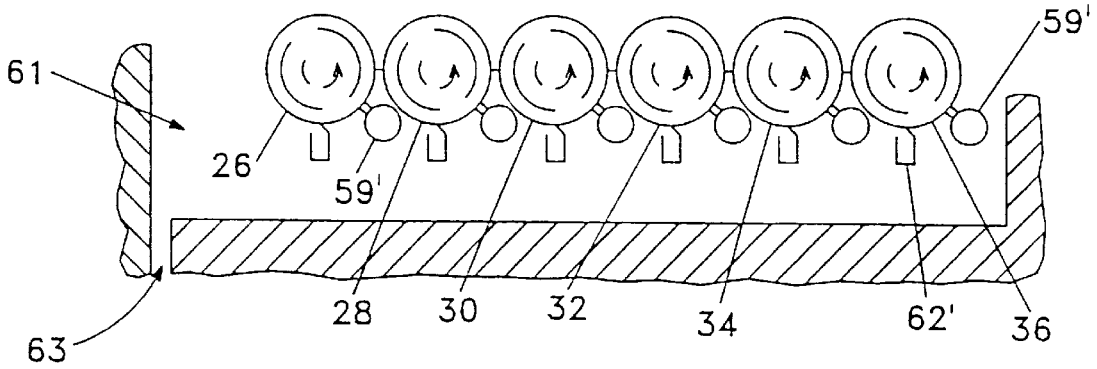
FIG. 5 is a partial view showing an alternative form for the invention re.
Figure 6:
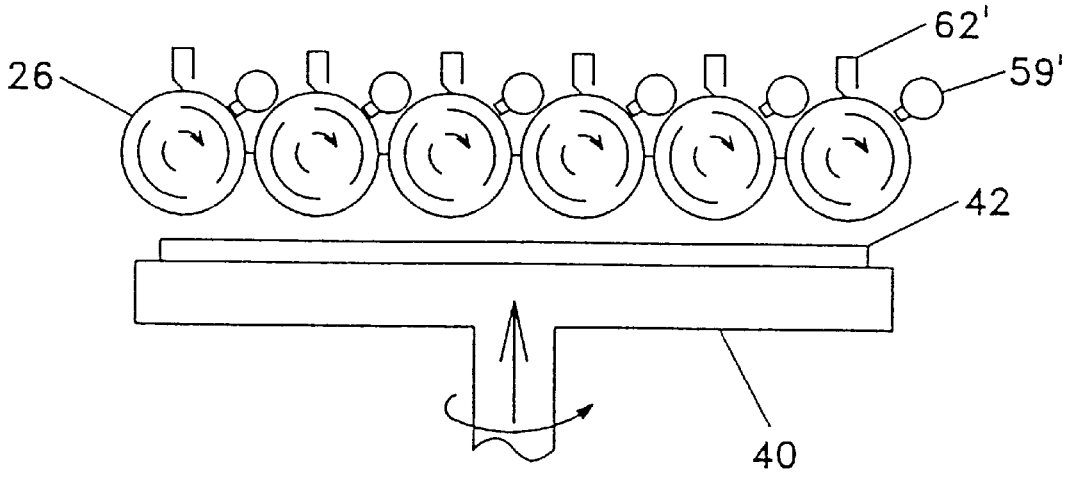
FIGS. 6 and 6*a* are views of the polishing rollers and an alternative work holder according to this invention.
Figure 6A:
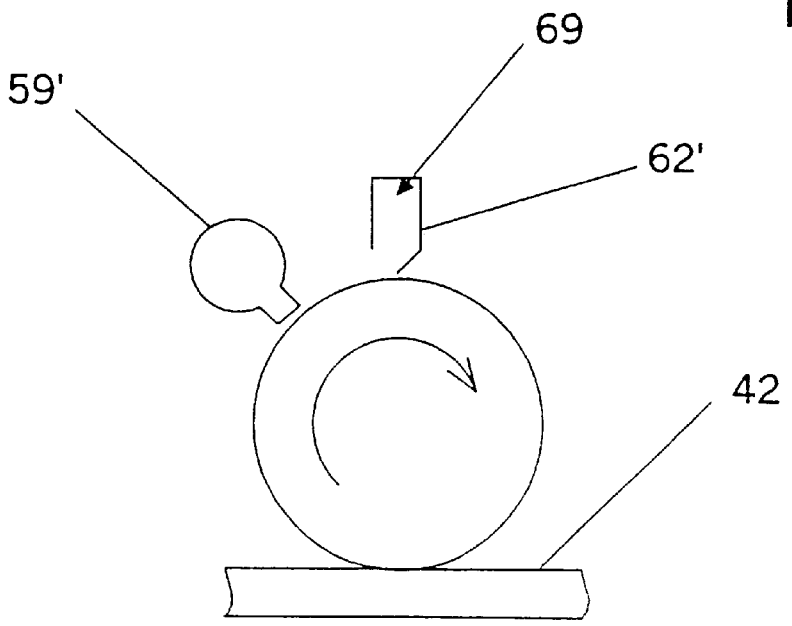
Figure 7:
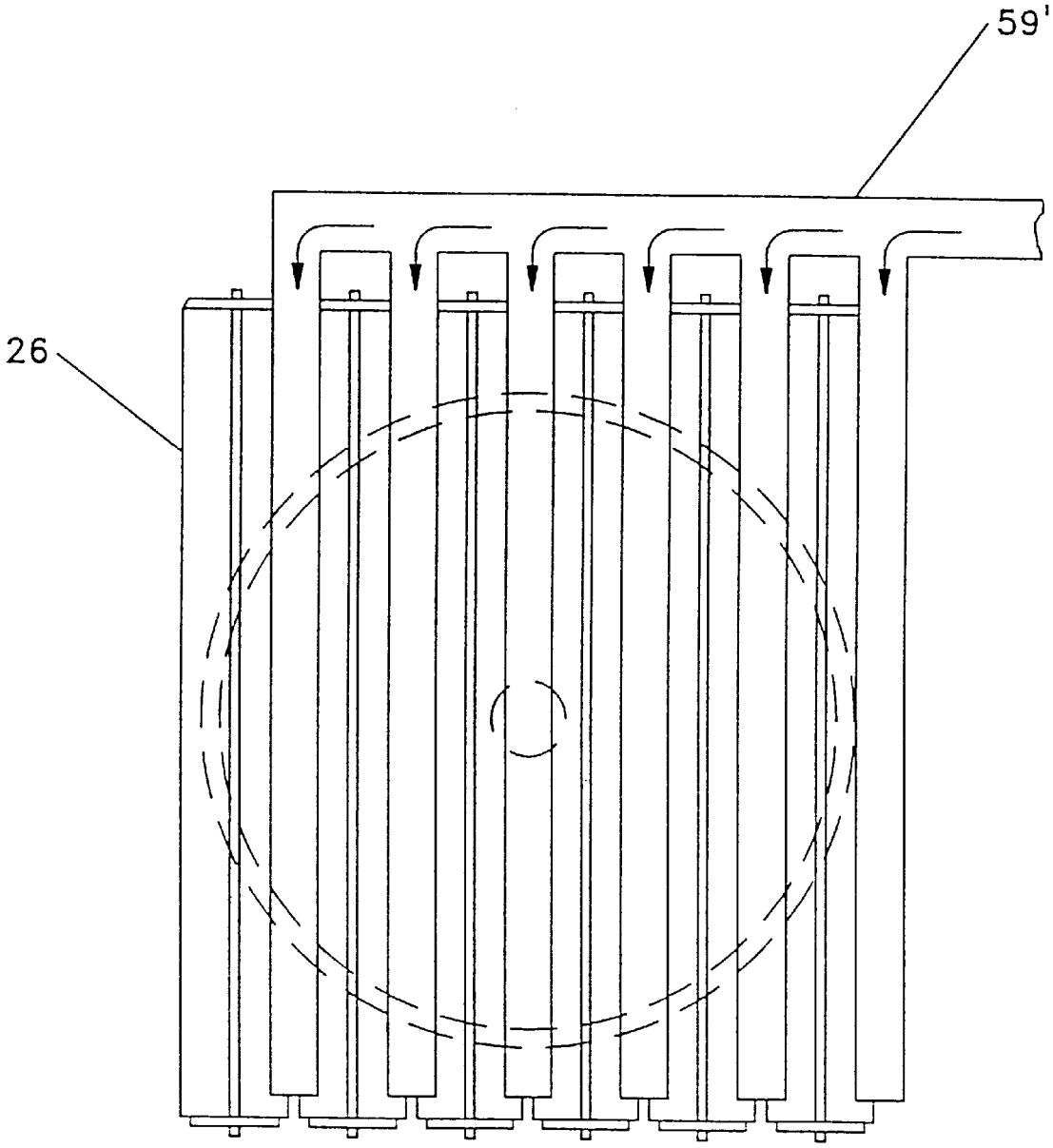
FIG. 7 is a top view of the componentary of FIG. 6 according to this invention.

In FIGS. 5, 6 and 7 other embodiments are shown having slurry delivered to each roller 26 thru 36 by manifolds 59' located after the conditioners 62'. The embodiment shown by FIG. 5 allows the used slurry to fall into tank area 61 for eventual drainage via port 63. As seen in FIG. 6*a* the conditioner, or scrapper as it may also be called, can be a hollow pipe 69 which can be attached to a vacuum sump to draw off used slurry removed from the rollers 28 thru 36. This will prevent such used slurry from dropping back onto the rollers. Such an arrangement also allows the holder 40 to be beneath the rollers 26 et al as seen in FIG. 6 and FIG. 7.

With reference to FIGS. 8 thru 12 there is shown a preferred mechanical arrangement of apparatus for driving the polishing rotors, holding the wafer for polishing and the means to obtain wafers from a storage cassette, transfer them to a polishing station and return the polished wafer to its storage cassette.

Figure 8:
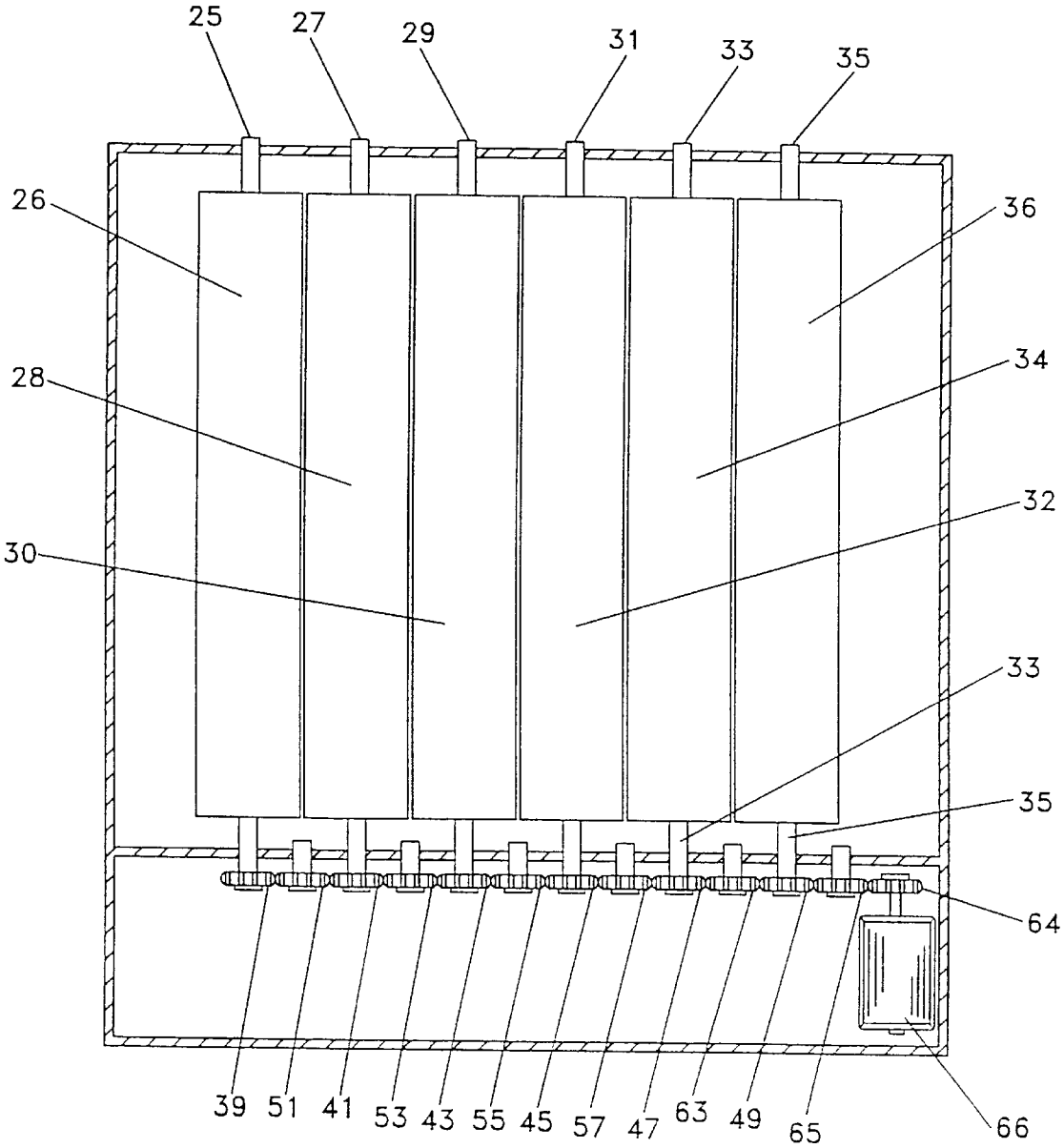
FIG. 8 is a view of the drive mechanism for the polishing rollers.

More particularly with reference to FIG. 8 rollers 26, 28, 30, 32, 34 and 36 are supported via bearings (not shown) on shafts 25, 27, 29, 31, 33 and 35. A gear train represented by drive gears 39, 41, 43, 45, 47 and 49 and idle gears 51, 53, 55, 57, 63 and 65 is driven by gear 64 from motor 66 such that each roller is driven at the same rotational velocity. It is possible to adjust gear ratio such that outer polishing rollers rotate at different speeds from the inner rollers.

Referring to FIG. 9 a preferred embodiment for the work holder 40 is detailed to comprise a wafer holding surface 68 mounted on a shaft 70 having a splined section 72 slidably related to a ring gear 82 driven by motor 74 thru gear 76 for rotating the wafer during polishing. Thrust bearing 78 and 80 hold the ring gear 82 in work holder 40. The shaft 70 terminates in a cylindrical boss 84 which is biased downwardly, in this installation shown, by a spring 86. Beneath the boss and connected thereto via a thrust bearing 88 is a hydraulically operated piston 90 extendable form cylinder 92 by hydraulic pressure introduced at 99 to raise the work holding surface 68 to allow the wafer thereon to be polished.

As seen by FIG. 9A the surface 68 is provided with lifting pins 94 and 96 which are operated by air pressure introduced at 97 to boss 84 to remove the wafer 42 (See FIG. 6). In addition a vacuum source 98 is also connected at boss 84 to be delivered to surface 68 to hold wafer 42 during polishing. As will be appreciated by those skilled in the art controls for such are readily available for introducing and porting such fluid sources.

Figure 10:
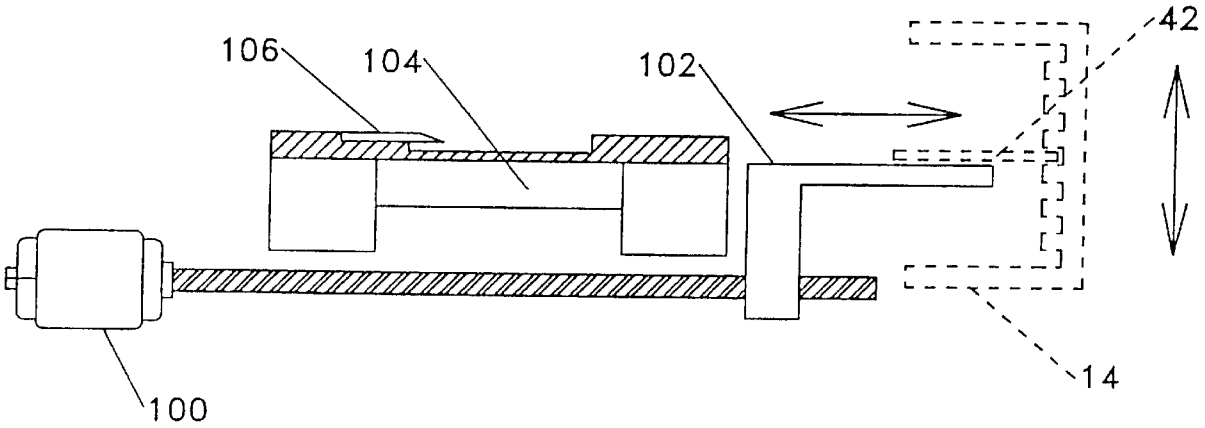
FIG. 10 is a view of the wafer transfer mechanism.
Figure 12:
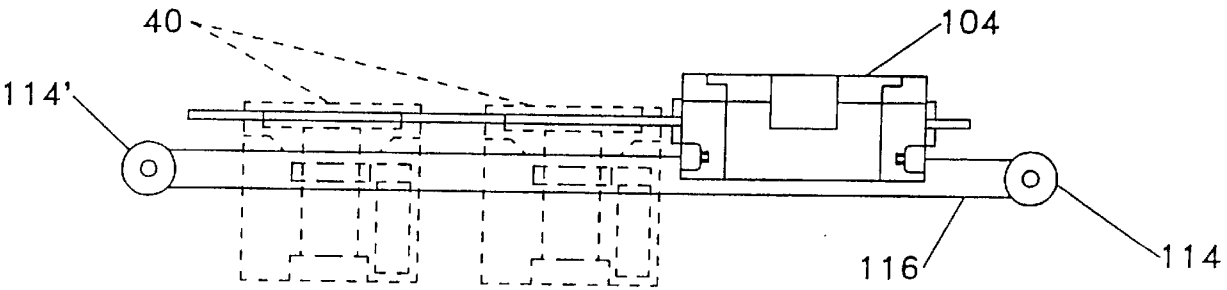
FIG. 12 is a view of the mechanism of FIG. 11 along lines 12—12.
Figure 11:
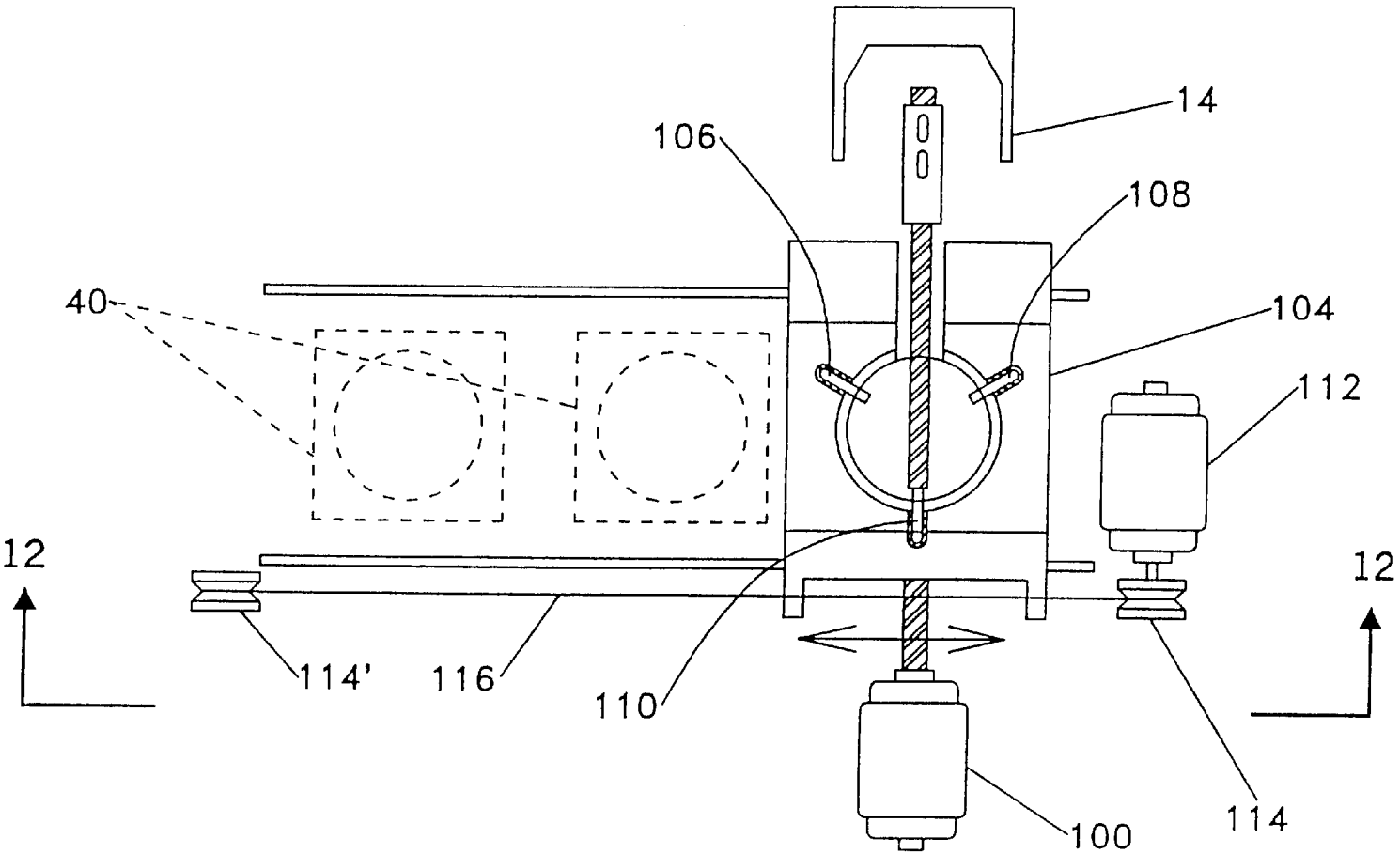
FIG. 11 is a plan view at a right angle of the wafer transfer mechanism.

The wafer transfer process from storage to polishing stations and return is more particularly shown by the FIGS. 10 through 12 to comprise, in a preferred embodiment, a screw drive actuator 100 operating a slide 102 that has a vacuum port which when moved under a wafer in a cassette, shown in phantom, will remove a wafer 42 and bring it to the wafer loader 104 that has air operated spring fingers 106, 108, 110 to support the wafer 42. Motor 112 drives pulley 114 to cause cable 116 to move loader 104 to a position over a wafer holder assembly of FIG. 9, shown in phantom in FIGS. 11 and 12 after which spring fingers 106, 108, 110 will be operated to drop the wafer 42 onto surface 68.

In operation this chemical, mechanical polisher provides enhanced roller contact area, nap conditioning and cleaning, slurry agglomeration removal, due to increased fluid movement off the work piece, wafer, surface rather than traveling with the pad and mechanically embedding into a porous surface.

It should be readily apparent that variations of the invention as set forth herein may be practiced by those skilled in the art without departing from the invention's essential scope. Therefore, the structure of the invention in which an exclusive property or privilege is claimed is defined as follows.

While the invention has been particularly shown and described with respect to preferred embodiments thereof, it will be understood by those skilled in the art that the foregoing and other changes in form and details may be made therein without departing from the spirit and scope of the invention.

Having thus described our invention, what we claim as new, and desire to secure by Letters Patent is:

1. Polishing apparatus comprising:

a work piece platen for holding a work piece to be polished;

a plurality of cylindrical rollers extending in parallel, coplanarly spaced array, each said roller including a polishing surface, drive means connected to each of said rollers to cause said rollers to be conjointly rotatable about their cylindrical axis;

means to wet said polishing surface of each of said cylindrical roller with a polishing agent;

conditioning means to remove used polishing agent from said rollers in advance of said means to wet said rollers with a polishing agent; and means to move said platen to engage a surface of the work piece with more than one of the polishing surface of the cylindrical rollers to allow said polishing surface to polish said work piece.

2. The polishing apparatus of claim 1 and further comprising means to rotate said platen about an axis perpendicular to the cylindrical axis of said cylindrical rollers.

3. The polishing apparatus of claim 1 wherein said conditioning means to remove used polishing agent is characterized as a hollow pipe connected to a vacuum source.

4. The polishing apparatus of claim 1 wherein said conditioning means to remove said used polishing agent includes a tank therebelow to receive said used polishing agent.

5. The polishing apparatus of claim 1 and further comprising said conditioning means conditioning the polishing surface of each of said rollers throughout the axial length thereof to receive a polishing agent.

6. The polishing apparatus of claim 1 and further comprising said conditioning means conditioning the polishing surface of each said roller throughout the axial length thereof ahead of the means to wet said polishing surface to facilitate surface absorption of the polishing agent.

7. The polishing apparatus of claim 1 and further comprising means located behind said means to condition the direction of rotation of said plurality of cylindrical rollers to wet each polishing surface with a polishing agent.

8. The polishing apparatus of claim 1 including a wafer receiving cassette;

said work piece platen comprising a wafer platen for receiving a wafer from said cassette; and a rotatable arm for moving said platen laterally through a cleaning station to a polishing station, back through the cleaning station to said cassette and further comprising:

means to move and rotate said wafer platen along and about, respectively, a first axis; and said plurality of cylindrical rollers mounted in said polishing station for rotation about their cylindrical axes perpendicular to said first axis to polish a surface upon said wafer being moved against at least some of said cylindrical rollers to be polished thereby.

9. The polishing apparatus of claim 8 wherein said plurality of cylindrical rollers are rotated about their cylindrical axis at the same velocity.

10. The polishing apparatus of claim 8 wherein each of said plurality of cylindrical rollers is rotated about its cylindrical axis at a predetermined rate.

* * * * *